US007520845B2

(12) United States Patent
Towley, III et al.

(10) Patent No.: US 7,520,845 B2
(45) Date of Patent: Apr. 21, 2009

(54) SELECTORIZED DUMBBELL HAVING KEYBOARD SELECTOR WITH DISCRETE CONNECTING PINS FOR INDIVIDUAL WEIGHTS

(75) Inventors: Carl K. Towley, III, Alexandria, MN (US); Gregory S. Olson, Owatonna, MN (US); William T. Ryder, Victoria, MN (US)

(73) Assignee: Intellex, Inc., Owatonna, MN (US)

( * ) Notice: Subject to any disclaimer, the term of this patent is extended or adjusted under 35 U.S.C. 154(b) by 206 days.

(21) Appl. No.: 11/498,335

(22) Filed: Aug. 2, 2006

(65) Prior Publication Data

US 2008/0032874 A1 Feb. 7, 2008

(51) Int. Cl.
*A63B 21/072* (2006.01)
*A63B 21/075* (2006.01)

(52) U.S. Cl. ..... 482/106; 482/107

(58) Field of Classification Search ..... 482/92, 482/93, 98, 106–108, 148, 908; *A63B 21/072*
See application file for complete search history.

(56) References Cited

U.S. PATENT DOCUMENTS

| | | | | |
|---|---|---|---|---|
| 4,529,198 | A | 7/1985 | Hettick, Jr. | |
| 5,769,762 | A | 6/1998 | Towley, III et al. | |
| 6,186,928 | B1 | 2/2001 | Chen | |
| 6,261,022 | B1 * | 7/2001 | Dalebout et al. | 482/107 |
| 6,322,481 | B1 * | 11/2001 | Krull | 482/107 |
| 6,682,464 | B2 * | 1/2004 | Shifferaw | 482/106 |
| 6,733,424 | B2 | 5/2004 | Krull | |
| 7,011,611 | B1 * | 3/2006 | Ripley | 482/107 |
| 7,066,867 | B2 * | 6/2006 | Krull | 482/108 |
| 7,128,696 | B1 * | 10/2006 | Krull | 482/107 |
| 7,172,536 | B2 * | 2/2007 | Liu | 482/108 |
| 7,238,147 | B2 * | 7/2007 | Mills et al. | 482/106 |
| 7,291,098 | B1 * | 11/2007 | Krull | 482/107 |
| 7,300,390 | B1 * | 11/2007 | Krull | 482/108 |
| 2007/0173386 | A1 * | 7/2007 | Wang | 482/107 |

* cited by examiner

*Primary Examiner*—Fenn C Mathew
*Assistant Examiner*—Andrew M Tecco
(74) *Attorney, Agent, or Firm*—James W. Miller

(57) ABSTRACT

A selector of a selectorized dumbbell comprises a keyboard having a plurality of keys that can be depressed into a weight selecting position. In this weight selecting position, a cam actuator on each key forces a pair of connecting pins apart to couple a particular weight to the handle. Preferably, to minimize the risk of accidental weight detachment from the handle, a pair of keys and two pairs of connecting pins couple each weight to the handle in a redundant fashion. The pins in each pair slide apart from one another to couple a weight to the handle and slide towards one another to uncouple a weight from the handle with the sliding motion of the pins being perpendicular to the axis of a hand grip of the handle.

26 Claims, 9 Drawing Sheets

SELECTORIZED DUMBBELL HAVING KEYBOARD SELECTOR WITH DISCRETE CONNECTING PINS FOR INDIVIDUAL WEIGHTS

TECHNICAL FIELD

This invention relates to a selectorized dumbbell having a selector that the user manipulates to adjust the mass of the dumbbell by coupling desired numbers of weight plates to each end of a handle. More particularly, this invention relates to a selector that couples the weight plates to the handle in an easy, intuitive and secure fashion.

BACKGROUND OF THE INVENTION

Selectorized dumbbells overcome the cost and space obstacles presented by traditional dumbbells. In a selectorized dumbbell, a plurality of weights nest together. The weights provide a stack of nested left weight plates and a stack of nested right weight plates. The left and right stacks of weight plates are separated from one another by a gap.

In a selectorized dumbbell, a handle is inserted into the gap between the left and right stacks of weight plates. A selector is then manipulated to determine how many of the left and right weight plates of the weights are coupled to the left and right ends of the handle. Once the selector is positioned to pick up a selected number of weights, the handle can then be lifted by the user from between the stacks of weight plates. The selected number of weights will rise with the handle to be used in performing various exercises with the dumbbell.

In a typical selectorized dumbbell, an insertable connecting pin comprises the selector to determine which weights are coupled to the handle. The connecting pin is inserted into various different positions relative to the handle and/or the weights. The position of the pin determines how many weights are picked up by the handle. The pin is often coupled to the dumbbell handle by a tether so that it will not be lost.

The use of an insertable pin is an effective selector for a selectorized dumbbell. However, it must be on hand to be effective. If it is lost, then no weights can be coupled to the handle until the pin is found or a replacement pin is purchased. While the pin is usually tethered to the handle to minimize the chances that the pin will be lost, the tether itself can get in the way of the user and can be bothersome to some users.

In addition, if the pin becomes inadvertently disconnected in some way while the user is exercising, then the weights that had been coupled to the handle by the pin may detach from the handle and fall to the floor. This poses a risk of injury to the user or to a bystander. In addition, the weights may be damaged if they drop to the floor from too high a height. While the instances of a pin becoming disconnected while the dumbbell is being used are rare, they are not totally unknown.

Moreover, using a single pin to couple different numbers of weights to the handle means that the pin must be strong enough to hold all of the weights that could possibly be loaded onto the handle. In other words, if the selectorized dumbbell has a maximum mass of 50 pounds when fully loaded, then the connecting pin has to support this maximum mass without deflecting or being broken. While one connecting pin used in a selectorized dumbbell is U-shaped having a pair of connecting prongs, nonetheless this double pronged structure must still be strong enough to support the maximum mass of the dumbbell. Thus, traditional connecting pins used in selectorized dumbbells necessarily have to be fairly large and robust.

Finally, some users can be unfamiliar with where and how to properly insert the connecting pin. If the connecting pin is not fully inserted or is improperly inserted, there may be a danger that the pin will become disconnected. This gives rise to the various disadvantages noted earlier.

Accordingly, there is a need in the art for a selectorized dumbbell having a selector that is easier and more intuitive to use, that is permanently carried on the handle, and that couples the various weights to the handle in a secure and foolproof manner that minimizes the risk that any weights can be accidentally or inadvertently detached from the handle.

SUMMARY OF THE INVENTION

One aspect of this invention relates to a selectorized dumbbell. The selectorized dumbbell comprises a plurality of nested weights, a handle, and a selector for coupling selected numbers of weights to the handle. The selector includes a keyboard that is operable by a user to select the weights that are to be coupled to the handle.

Another aspect of this invention relates to a selectorized dumbbell which comprises an array of nested weights comprising a stack of nested left weight plates and a stack of nested right weight plates. A handle is provided having a left end and a right end. A selector couples selected numbers of left weight plates to the left end of the handle and selected numbers of right weight plates to the right end of the handle. The selector includes a plurality of keys equal to the number of the weight plates with the keys being placed on a keyboard in an arrangement corresponding to that of the array of nested left and right weight plates. The keys are selectively actuable by a user such that actuation of a key in the keyboard selects for coupling to the handle that weight plate whose position in the array of weight plates is the same as the position of the actuated key in the keyboard.

Yet another aspect of this invention relates to a selectorized dumbbell which comprises a plurality of nested weights, a handle, and a selector for coupling selected numbers of weights to the handle. The selector includes a plurality of connecting pins. At least one separate and discrete connecting pin is used to couple each weight to the handle.

An additional aspect of this invention relates to a selectorized dumbbell which comprises a plurality of nested weights, a handle, and a selector for coupling selected numbers of weights to the handle. The selector includes a pin array having a plurality of connecting pins whose length increases from one pin to the next.

A further aspect of this invention relates to a selectorized dumbbell which comprises a plurality of nested weights which provide a set of nested left weight plates and a set of nested right weight plates separated by a gap. The weights include apertures therein. A handle is provided having a hand grip. The handle is insertable into the gap between the sets of nested left and right weight plates with the handle extending along an axis that is substantially perpendicular to that of the weight plates. A selector is provided for coupling selected numbers of weights to the handle. The selector includes a plurality of individually movable connecting pins carried on the handle with the connecting pins being received in the apertures for connecting the weights to the handle. The apertures and connecting pins are configured to permit the handle to be inserted into the gap in a first position or in a second position that is 180° reversed from the first position without affecting the ability of the apertures and the connecting pins to couple the weights to the handle.

One more aspect of this invention relates to a selectorized dumbbell which comprises a plurality of nested weights, a handle, and a selector for coupling selected numbers of weights to the handle. The selector includes a plurality of individually movable connecting pins that can be bi-stably retained in either a first weight coupling position or a second weight uncoupling position. Spring biasing acts on the pins such that the pins cannot be left in an intermediate position between the first and second positions since the spring biasing will then act on the pins to return the pins to one of the first and second positions thereof.

BRIEF DESCRIPTION OF THE DRAWINGS

This invention will be described more completely in the following Detailed Description, when taken in conjunction with the following drawings, in which like reference numerals refer to like elements throughout.

FIG. 8 is a cross-sectional view similar to FIG. 7, but particularly illustrating the selector having been lowered into the weight frame of the weight shown in FIG. 7 and with the key that controls the pair of connecting pins for this weight now shown in its lowered selecting position with the pins extended away from one another to extend into the weight frame of the weight to couple this weight to the handle;

DETAILED DESCRIPTION

Figure 1:
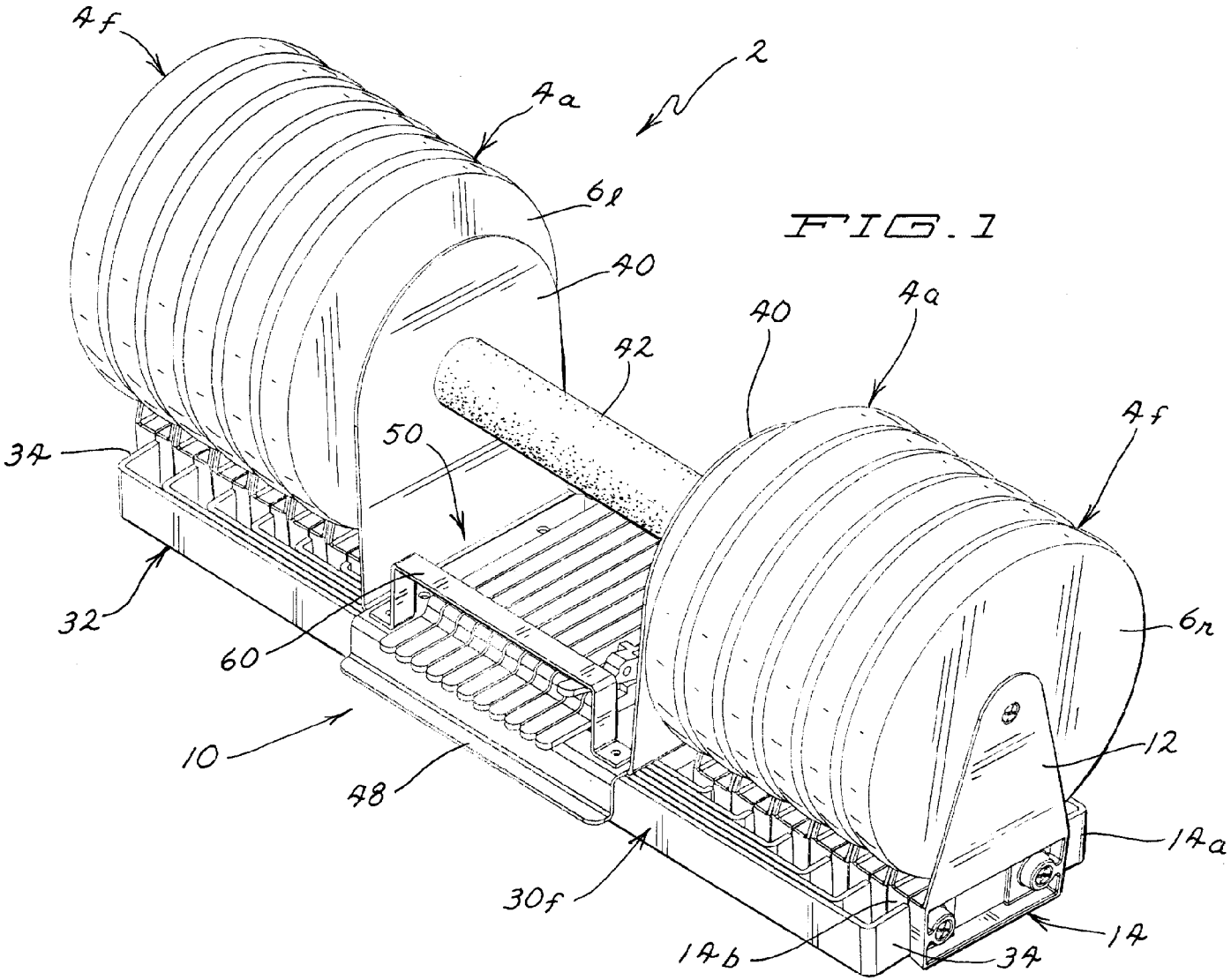
FIG. 1 is a perspective view of one embodiment of a selectorized dumbbell according to this invention, particularly illustrating the keys of the keyboard selector located beneath the hand grip of the handle.
Figure 2:
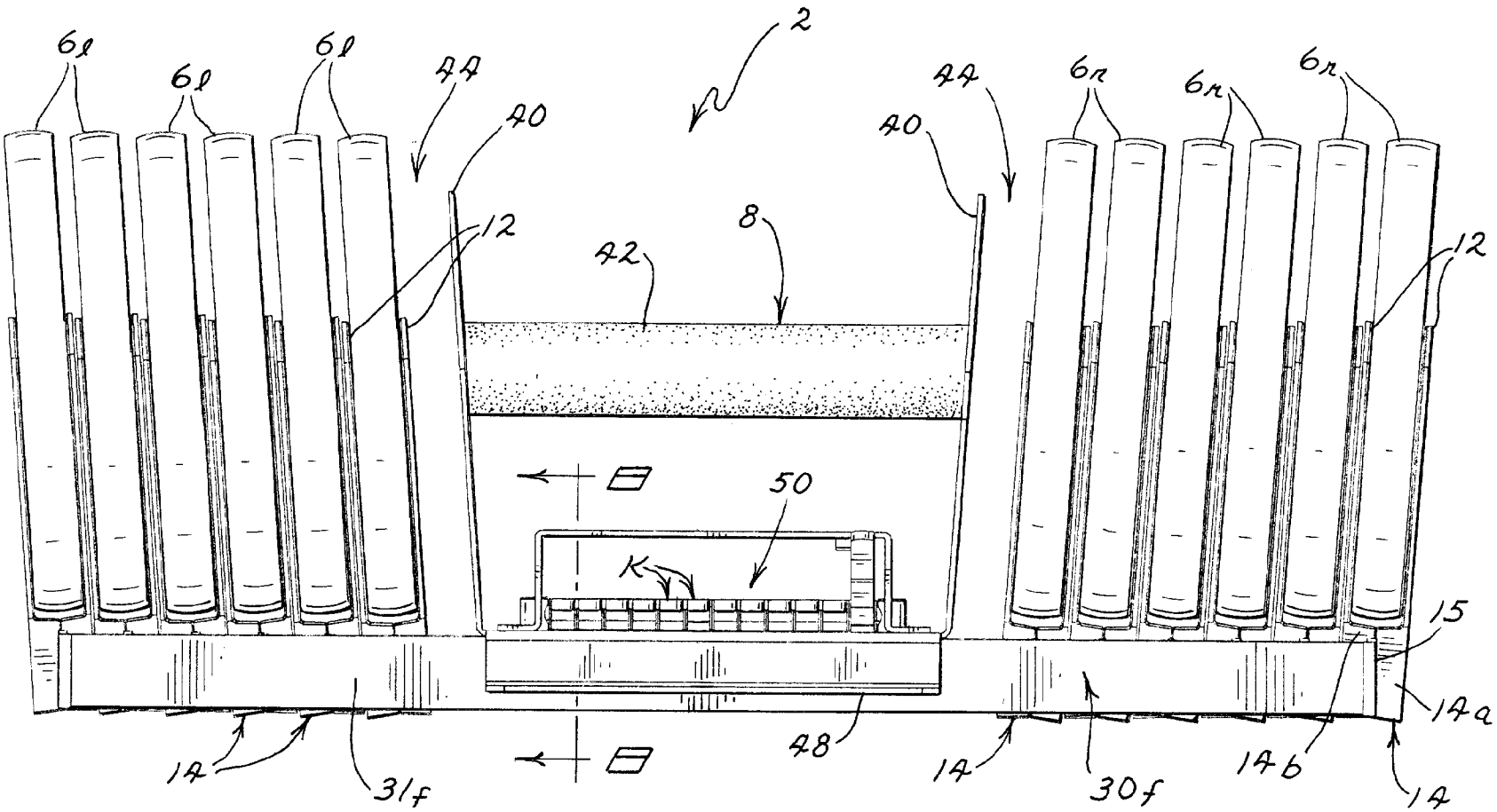
FIG. 2 is a front elevational view of the selectorized dumbbell of FIG. 1.
Figure 3:
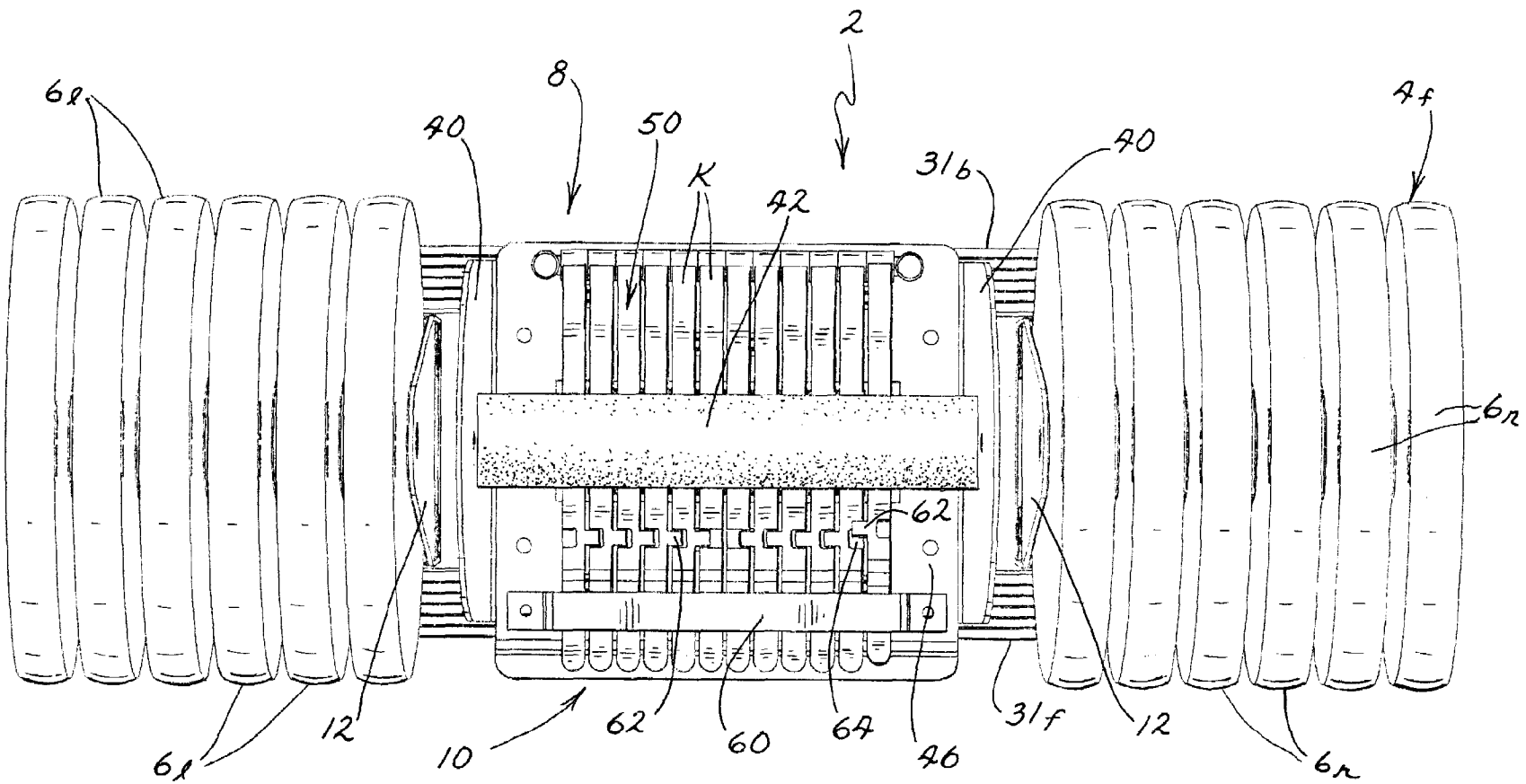
FIG. 3 is a top plan view of the selectorized dumbbell of FIG. 1.

One embodiment of a selectorized dumbbell according to this invention is illustrated generally as 2 in FIG. 1. Dumbbell 2 is similar to that shown in the Applicants' U.S. Pat. No. 5,769,762, which is hereby incorporated by reference. Dumbbell 2 is also similar to that shown in the Applicants' published U.S. patent application 2004/0162198, which is also hereby incorporated by reference. Only those features of dumbbell 2 which relate to this invention will be described in detail herein. The materials incorporated by reference above can supply other information regarding the general structure and operation of dumbbell 2 in the event the reader hereof desires or requires such information.

The Nested Weights of the Dumbbell

Dumbbell 2 has six nested weights $\mathbf{4}_a$-$\mathbf{4}_f$. See FIG. 4. The first weight $\mathbf{4}_a$ is the innermost weight in the array of nested weights in that it is the shortest and the narrowest weight 4. The second weight $\mathbf{4}_b$ is the next outer weight in the array of nested weights 4 in that the second weight $\mathbf{4}_b$ is a bit longer and wider than the first weight $\mathbf{4}_a$ to allow the first weight $\mathbf{4}_a$ to nest within the second weight $\mathbf{4}_b$. Each adjacent weight 4 continues to be a bit longer and wider than the adjoining inner weight 4 until one reaches the sixth or last weight $\mathbf{4}_f$ in the array. The weight $\mathbf{4}_f$ is the longest and widest of the weights 4.

Referring to FIGS. 1-4, each weight 4 preferably includes a pair of spaced apart weight plates 6. Weights 4 thus collectively provide a stack of six nested left weight plates $\mathbf{6}_l$ and a stack of six nested right weight plates $\mathbf{6}_r$. Each weight 4 includes one left weight plate $\mathbf{6}_l$ and one right weight plate $\mathbf{6}_r$. The number of nested weights 4, and thus the number of nested left and right weight plates $\mathbf{6}_l$ and $\mathbf{6}_r$, can obviously vary.

Each weight 4 comprises a weight frame 32 for joining one left weight plate $\mathbf{6}_l$ and one right weight plate $\mathbf{6}_r$ together in the spaced apart orientation. Weight frame 32 comprises generally upright front and back walls $\mathbf{31}_f$ and $\mathbf{31}_b$. Front and back walls $\mathbf{31}_f$ and $\mathbf{31}_b$ are formed by the elongated main bodies of a pair of steel rails, namely a front rail $\mathbf{30}_f$ and a back rail $\mathbf{30}_b$. Each steel rail 30 has inturned opposite ends 34.

Weight frame 32 also comprises a pair of carriers 14 secured to opposite ends of rails 30. One carrier 14 holds the left weight plate $\mathbf{6}_l$ and the other carrier 14 holds the right weight plate $\mathbf{6}_r$. Thus, each weight 4 includes a pair of rails 20, a pair of carriers 14, and a pair of weight plates comprising one left weight plate $\mathbf{6}_l$ and one right weight plate $\mathbf{6}_r$.

Figure 4:
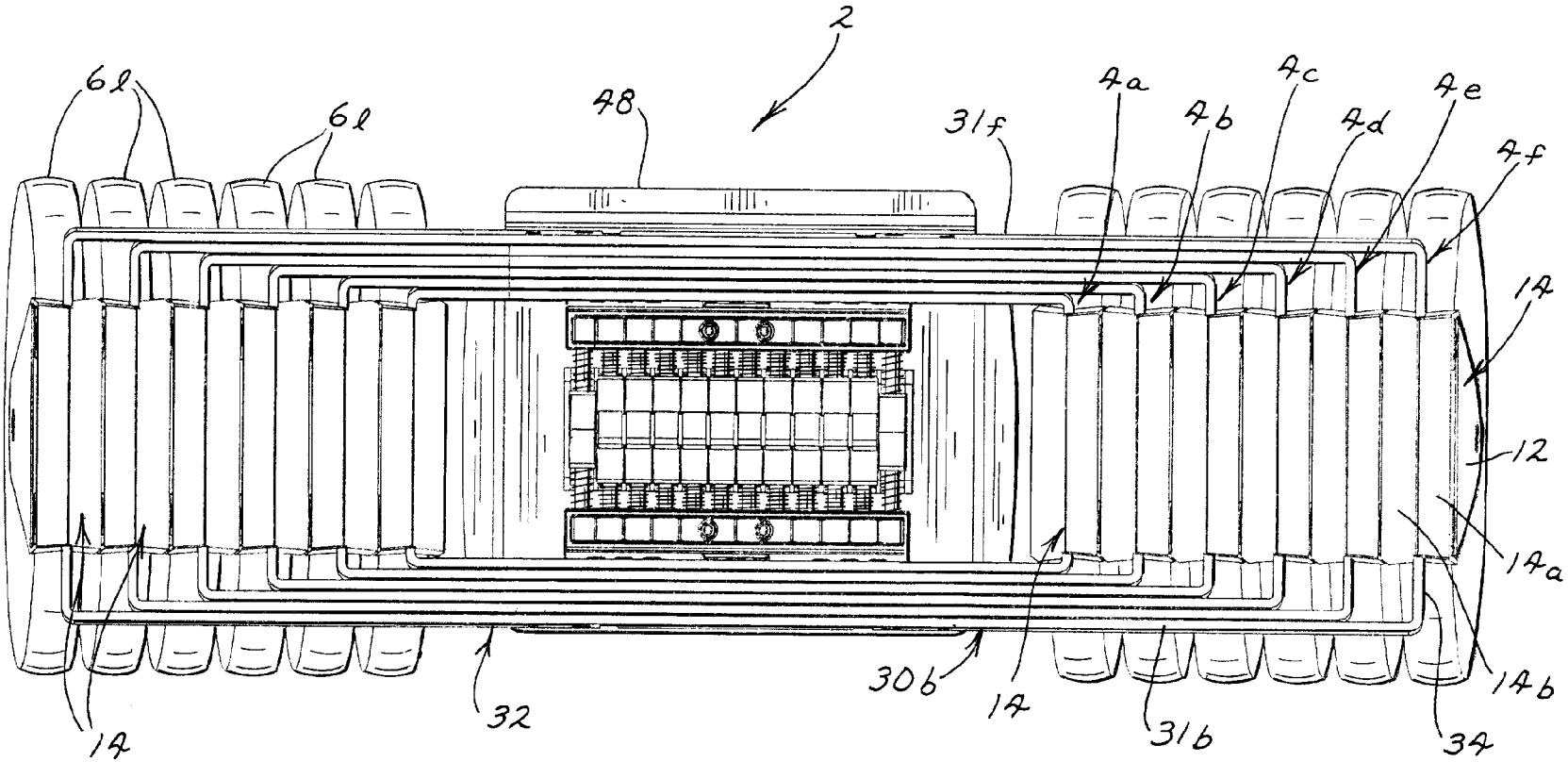
FIG. 4 is a bottom plan view of the selectorized dumbbell of FIG. 1.

Each carrier 14 is made in two halves $\mathbf{14}_a$ and $\mathbf{14}_b$ as indicated in FIG. 4 by the parting line 15 between halves $\mathbf{14}_a$, $\mathbf{14}_b$. The inturned ends 34 of rails 30 are bolted between carrier halves $\mathbf{14}_a$, $\mathbf{14}_b$ to attach rails 30 to carriers 14 to thereby make up one weight frame 32. Each carrier 14 includes a pair of upwardly extending arms 12 with one arm 12 being provided on each carrier half $\mathbf{14}_a$ or $\mathbf{14}_b$. A single weight plate 6 is held between the arms 12 of each carrier 14 by a cross hub (not shown) formed on arms 12 extending through a central hole (not shown) in each weight plate 6. A fastener, such as a bolt 26, is used to secure arms 12 together with weight plate 6 held therebetween.

Weight frames 32 of weights 4 are progressively longer from side to side as one proceeds from the innermost weight $\mathbf{4}_a$ to the outermost weight $\mathbf{4}_b$. Thus, the left and right weight plates $\mathbf{6}_l$ and $\mathbf{6}_r$ of each weight 4 are progressively spaced further and further apart. This is what provides the stack of nested left weight plates $\mathbf{6}_l$ and the stack of nested right weight plates $\mathbf{6}_r$ separated from one another by a gap. This gap is long enough to allow a handle 8, which will be described in more detail hereafter, to be dropped down or inserted into the gap between the separated stacks of nested left and right weight plates $\mathbf{6}_l$ and $\mathbf{6}_r$.

In addition, weight frames 32 of weights 4 are progressively wider from front to back as one proceeds from the innermost weight 4 to the outermost weight 4. Thus, the front walls $\mathbf{31}_f$ of each weight frame 32, which are formed respectively by front rails $\mathbf{30}_f$, nest closely adjacent one another. Similarly, the back walls $\mathbf{31}_b$ of each weight frame 32, which are formed respectively by back rails $30_b$, also nest closely adjacent one another. See FIG. 9 which shows the two nested stacks of front and back walls $31_f$ and $31_b$ separated from one another across the front to back width of dumbbell 2. As will be described hereafter, front and back walls 31 of weight frames 32 have apertures 80 that coact with a selector 10 to determine which weights are coupled to handle 8.

The construction of weights 4 can vary. For example, each carrier 14 could comprise an integral, single ear or tongue bent up out of each end of a metallic, channel shaped weight frame as shown in the published patent application earlier incorporated by reference herein. Alternatively, weight plates 6 could simply be welded to opposite ends of a metallic weight frame without using an intervening carrier 14 as shown in the issued patent earlier incorporated by reference herein. Moreover, each weight 4 could comprise only a single weight plate 6 rather than a construction which employs two spaced weight plates 6. In this latter alternative, the stacks of nested left and right weight plates 6 would be provided simply by a plurality of separate weights 4 grouped into such stacks.

The Handle of the Dumbbell

Handle 8 of dumbbell 2 includes a pair of generally vertically extending ends 40 that are spaced apart a distance at least slightly less than the distance between weight plates $6_l$ and $6_r$ of innermost weight $4_a$. A hand grip 42 extends between and is secured to ends 40 of handle 8. Hand grip 42 extends along the longest axis of dumbbell 2 such that hand grip 42 is perpendicular to weight plates 6. As is well known for selectorized dumbbells, handle 8 can be dropped down between the stacks of nested left and right weight plates $6_l$ and $6_r$ to couple desired numbers of such weight plates to ends 40 of handle 8.

A space 44 is provided between each end 40 of handle 8 and the left weight plate $6_l$ and the right weight plate $6_r$ of innermost weight $4_a$. This permits an auxiliary weight (not shown) to be fastened to the outside of each end 40 of handle 8 by any suitable means. For example, the auxiliary weight could simply be bolted to the outside of each end 40 of handle 8. When so affixed, one auxiliary weight would be located in each space 44.

Each auxiliary weight will preferably be approximately ½ the weight of each weight plate 6 and thus approximately ¼ of the weight of each entire weight 4. This provides an incremental adjustment capability to dumbbell 2 to permit the user to select increments in between the usual exercise masses provided by dumbbell 2. For example, if the auxiliary weights are in use, the user is able to select 15 pounds instead of 10 pounds, 25 pounds instead of 20 pounds, and so on. Alternatively, the spaces 44 shown in the drawings between each end of handle 8 and the left and right weight plates $6_l$ and $6_r$ of the innermost weight $4_a$ could be eliminated. In this case, each end 40 of handle 8 would be closely adjacent against the left and right weight plates $6_l$ and $6_r$ of the innermost weight $4_a$.

Ends 40 of handle 8 are also connected at their bottoms by a floor 46. Floor 46 serves as a mount or support for selector 10. Preferably, floor 46 overlies substantially the entire front to back width of dumbbell 2 with the underside of floor 46 resting on top of the front and back rails 30 of the various weight frames 32. The front of floor 46 includes an L-shaped guard 48, whose purpose will be described in more detail hereafter.

The Selector of the Dumbbell

Dumbbell 2 of this invention includes a novel selector 10 for coupling weights 4 to handle 8. Selector 10 is carried on floor 46 of handle 8. Selector 10 comprises a keyboard 50 having a plurality of side by side weight selection keys k. Selector 10 also comprises a plurality of weight connecting pins 52 that are actuated by movement of weight selection keys k. Keys k and connecting pins 52 together couple desired numbers of weights 4 to handle 8 of dumbbell 2 to selectively vary the exercise mass.

Referring now to FIGS. 6-9, keyboard 50 of selector 10 is carried atop floor 46 of handle 8 to be easily accessible to the user. Keyboard 50 comprises a plurality of keys k that are pivotally mounted on a pivot shaft 54 carried along the back side of floor 46. Each key k extends across floor 46 from its connection to pivot shaft 56 to terminate in a front end 58 adjacent to and overlying front walls $31_f$ of weight frames 32. Preferably, keys k are long enough so that front ends 58 of keys k project forwardly past the front edge of floor 46 and past front walls $31_f$ of weight frames 32. This enables a user to place a finger beneath front end 58 of each key to lift up on key k when so desired.

Figure 6:
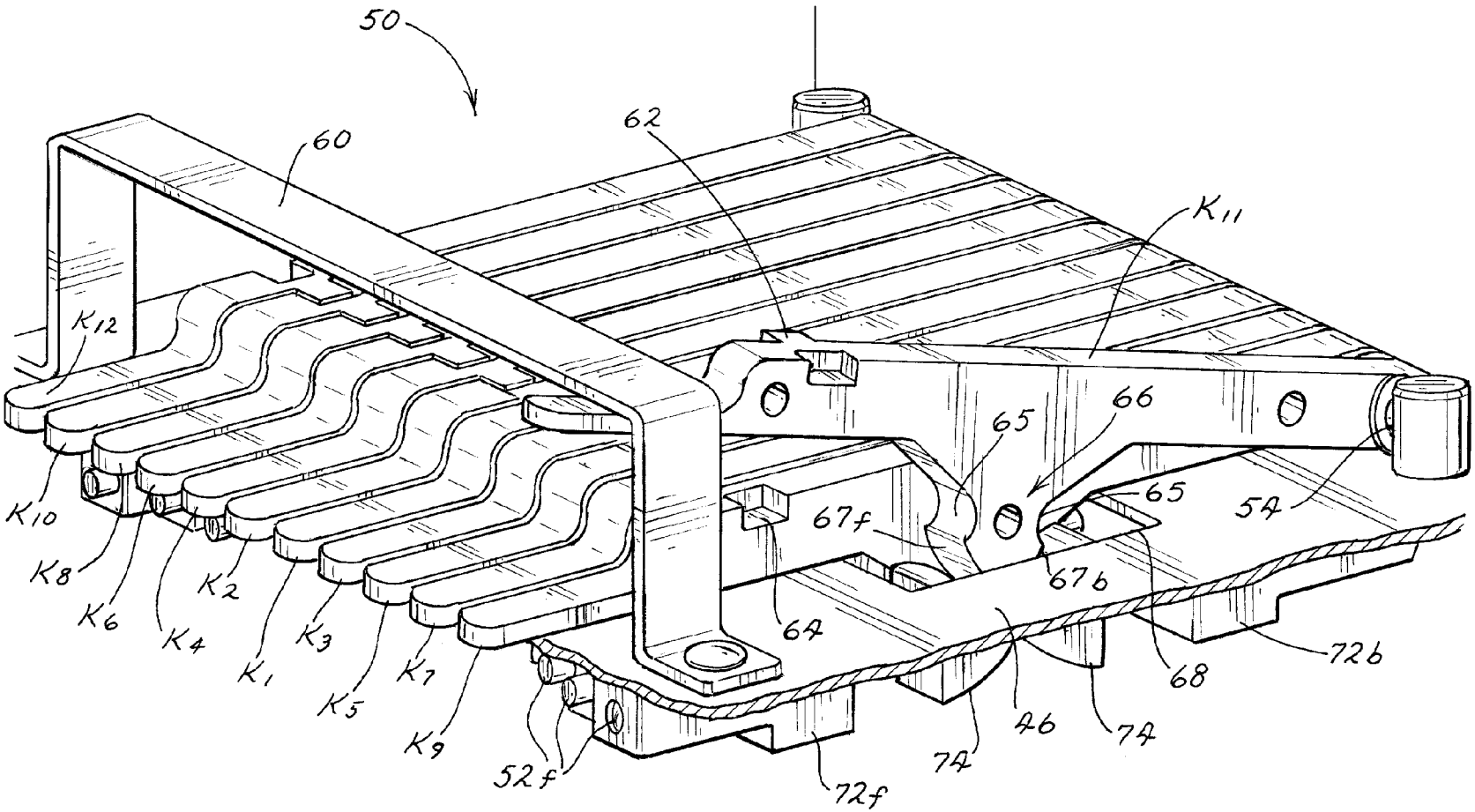
FIG. 6 is an enlarged perspective view of the selector of the selectorized dumbbell of FIG. 1, particularly illustrating the keyboard with one of the weight selection keys thereof shown in a raised non-selecting position and the remaining keys thereof being located in a lowered selecting position.
Figure 6:
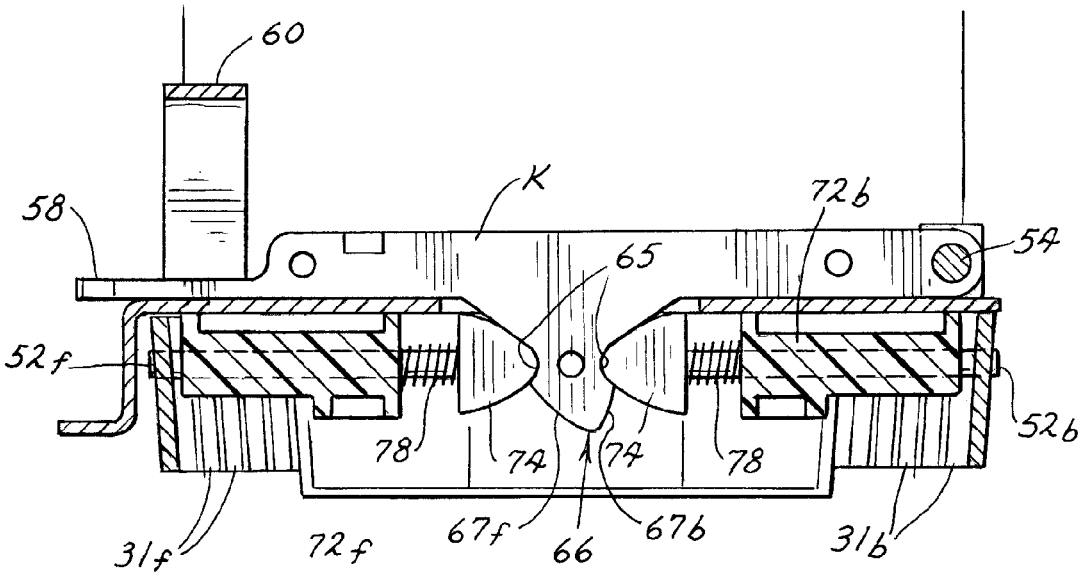
Figure 7:
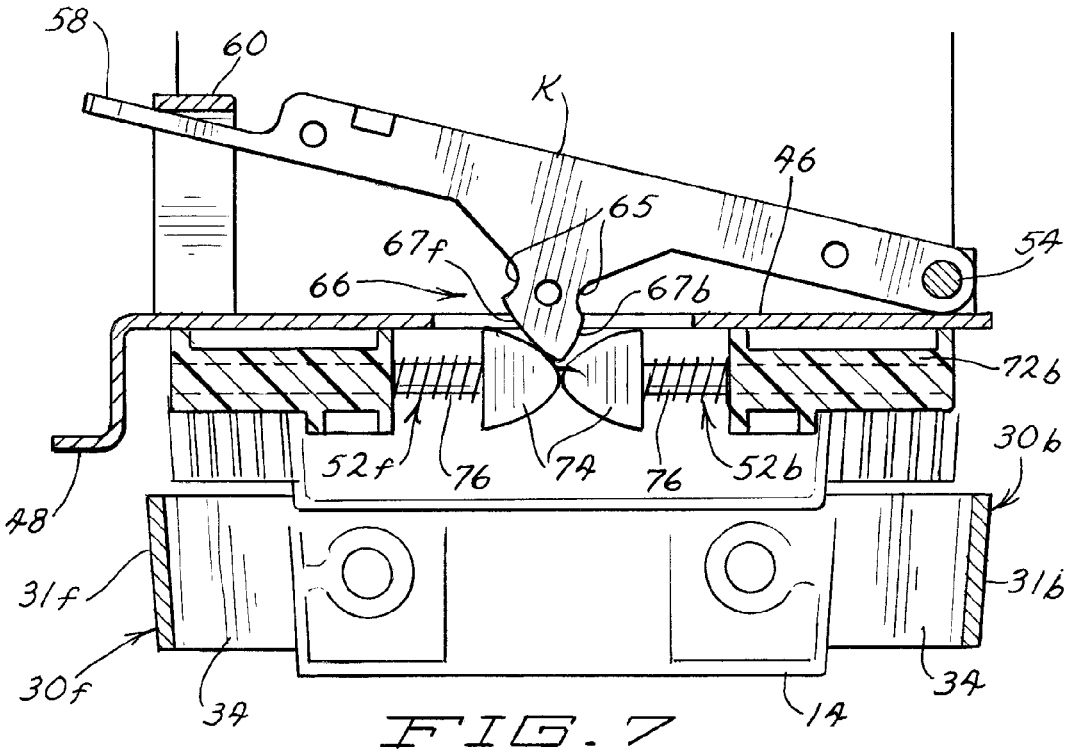
FIG. 7 is a cross-sectional view through the selector of FIG. 6, particularly illustrating the selector raised above the weight frame of an uncoupled weight with the key that controls the pair of connecting pins for this weight being located in its raised non-selecting position with the pins retracted towards one another.

Each key k in keyboard 50 can be lifted into a raised position shown in FIGS. 6 and 7. In this raised position, key k is inclined upwardly relative to floor 46 and abuts with the underside of a bridge 60 that overlies front ends 58 of keys k. The raised position of key k is a weight non-selecting position. Each key k in keyboard 50 can also be pushed down or depressed into a lowered position shown in FIG. 8. In this lowered position, key k lies flat atop floor 46. The lowered position of key k is a weight selecting position.

There are two weight selection keys k for each nested weight of dumbbell 2. Because there are six weights, there are twelve keys k. Keys k are arranged from side to side across keyboard 50 in the following pattern when looking at the front of keyboard 50 and when going from left to right:

12 10 8 6 4 2 1 3 5 7 9 11 Numbered Key Pattern.

Keys $k_1$ and $k_2$ are used to select the innermost weight $4_a$, keys $k_3$ and $k_4$ are used to select the next outer weight $4_b$ comprising the second weight 4 in the array of nested weights 4, keys $k_5$ and $k_6$ select the third weight $4_c$, and so on with keys $k_{11}$ and $k_{12}$ selecting the outermost weight $4_f$.

Depressing only one key k in each pair of keys k is effective to select the corresponding weight 4 for coupling to handle 8. For example, referring to FIGS. 6 and 7, both keys k in the key pairs for the first five weights $4_a$-$4_e$ are shown depressed into their weight selecting positions. However, for the key pair comprising keys $k_{11}$ and $k_{12}$ for the sixth and outermost weight $4_f$, key $k_{11}$ is shown in its raised non-selecting position while key $k_{12}$ is shown in its depressed selecting position. Nonetheless, the sixth weight $4_f$ will still be selected just like the first five weights $4_a$-$4_e$ and will be coupled to handle 8 such that handle 8 when lifted will carry all six weights $4_a$-$4_f$ with it.

The use of a pair of keys k to select each weight 4 for coupling to handle 8 is a safety feature. If only a single key k were used and that key k were inadvertently lifted when dumbbell 2 was in use, it would be possible for the weight corresponding to that key k to become detached from handle 8. However, it is highly unlikely that both keys k in a particular pair used to select a particular weight would be inadvertently dislodged or lifted at the same time. Thus, by using a pair of keys k for each weight 4 with either key k alone being sufficient to select the weight, the chances of unintentionally uncoupling a particular weight 4 from handle 8 are diminished. However, if so desired, keyboard 50 could be arranged with only six keys k for selecting the six different weights $4_a$-$4_f$, with the added safety provided by the key pairs then being absent.

Another safety feature is a positive interlock between keys k in which the left or even numbered keys are interlocked together and the right or odd numbered keys are also interlocked together. The term "interlock" or "interlocked" in this regard means that depressing any one of the interlocked keys requires that all of the inboard keys in the interlocked set must also be depressed.

To illustrate the interlock principle, assume we are looking at just the six interlocked left keys as follows:

12 10 8 6 4 2.

If the user depresses key $k_6$, then keys $k_4$ and $k_2$ (i.e. the keys that are inboard of key $k_6$ in the set of interlocked left keys) must also be depressed. The same principle applies to the odd numbered keys as follows:

1 3 5 7 9 11.

For example, if the user depresses key $k_7$, then the three inboard keys $k_1$, $k_3$ and $k_5$ must also be depressed. The interlock functions only one way however, namely when keys k are being depressed. If in the last example key $k_7$ is being lifted, then keys $k_1$, $k_3$ and $k_5$ are not required to be lifted as well. They can remain depressed.

The interlock of the even numbered keys to one another and the odd numbered keys to one another is achieved by a inwardly extending lateral tab 62 on all but the innermost key in each set of interlocked keys. Tab 62 is designed to fit into an upwardly facing mating recess 64 on all but the outermost key in each set of interlocked keys. Thus, again taking the example of the odd numbered keys:

1 3 5 7 9 11, then keys $k_3$, $k_5$, $k_7$, $k_9$ and $k_{11}$ all have lateral tabs 62 on their inner sides while keys $k_1$, $k_3$, $k_5$, $k_7$, and $k_9$ all have upwardly facing mating recesses 64 in their outer sides to receive the inwardly extending lateral tabs 62 on the adjacent keys k. FIG. 6 shows one such tab 62 on the raised key $k_{11}$ that will engage in recess 64 on the inner adjacent key $k_9$. The same tab/recess arrangement is used on the even numbered keys.

If one assumes that all of keys k are initially in their raised non-selecting positions, depressing any even or odd numbered key will force or depress all of the remaining and inboard even or odd numbered keys down as well. This is due to the interaction of each tab 62 with recess 64 in each adjacent key. For example, referring once again to the odd numbered keys:

1 3 5 7 9 11, assume all keys k are raised and then key $k_5$ is depressed. If key $k_5$ is depressed, then tab 62 on key $k_5$ will push downwardly on recess 64 in key $k_3$ to depress key $k_3$, and tab 62 on key $k_3$ will also push downwardly on recess 64 in key $k_1$ to depress key $k_1$. Thus, pushing down any key in either the odd or even numbered sets of keys necessarily depresses the other inboard keys in the same set of keys.

As will be described hereafter, keys k are acted upon by a spring bias such that the user must depress keys k against the spring bias. If a user pushes down on one key in the odd or even numbered sets of keys, the user must overcome the bias on that key as well as the bias on all of the inboard keys in that interlocked set. This is fairly easy to do if one, two or perhaps three keys are being pushed down or depressed simultaneously, However, it becomes more difficult to do if one attempts to depress all six keys by just pushing down on the outermost key in the set, e.g. if one attempts to depress keys 1 3 5 7 9 11 just by pushing down on key $k_{11}$. In this situation, the user would push down keys k in groups beginning with the inner keys and working out to the outer keys. For example, the user would first push down keys $k_1$ and $k_3$, then move out and push down keys $k_5$ and $k_7$ next, and then finally move further out and push down keys $k_9$ and $k_{11}$ last.

If desired, indicia could be provided somewhere on handle 8 for use with keys k to indicate how much dumbbell 2 weighs when particular pairs of keys are depressed. For example, indicia could be printed, stamped or molded on the top of bridge 60 to overlie the raised outer end 58 of each key k when key k is in its raised non-selecting position. Assuming the nominal weight of handle 8 is 5 pounds and each weight adds 10 pounds to handle 8, then bridge 60 would be labelled to show the six different exercise masses that could be selected. The indicia on bridge 60 could be in the following pattern corresponding to the pattern of the keys k:

| | | | | | | | | | | | | |
|---|---|---|---|---|---|---|---|---|---|---|---|---|
| 65 | 55 | 45 | 35 | 25 | 15 | 15 | 25 | 35 | 45 | 55 | 65 | Indicia Pattern; |
| 12 | 10 | 8 | 6 | 4 | 2 | 1 | 3 | 5 | 7 | 9 | 11 | Key Pattern. |

Thus, a user would know which keys to depress to pick a particular exercise mass. If the user wanted dumbbell 2 to weigh 35 pounds in the above example, then the user would depress the following keys from the odd and even numbered sets of keys:

6 4 2 1 3 5.

If the user wanted only 15 pounds, then the user would depress only the following keys:

2 1.

The nature of the indicia placed on bridge 60 could obviously vary. In addition, instead of indicia printed on bridge 60 or some other portion of handle 8, keys k could themselves be labelled or color coded to indicate the various weights that can be selected.

Each key k includes a downwardly pointing, double lobed cam actuator 66 on the underside thereof. Cam actuator 66 has a rounded front cam lobe $\mathbf{67}_f$ and a rounded back cam lobe $\mathbf{67}_b$. In addition, cam actuator 66 includes a recessed detent 65 above each of the front and back cam lobes $\mathbf{67}_f$ and $\mathbf{67}_b$.

Cam actuators 66 on all keys k are received over in a slot 68 in floor 46 of handle 8. In the raised non-selecting position of a key k, the cam actuator 66 carried by that key k is raised upwardly relative to floor 46 of handle 8 such that cam actuator 66 projects only a small distance into slot 68. This is shown in FIG. 7. In the lowered selecting position of key k, cam actuator 66 is lowered downwardly relative to floor 46 of handle 8 such that cam actuator 66 now projects a greater distance downwardly into slot 68. This is shown in FIG. 8.

Cam actuator 66 on each key k operates on a pair of front and back connecting pins $\mathbf{52}_f$ and $\mathbf{52}_b$. There are twelve keys k with twelve cam actuators 66 so there are twelve pairs of front and back connecting pins $\mathbf{52}_f$ and $\mathbf{52}_b$. Thus, there are twelve front connecting pins $\mathbf{52}_f$ contained in a front pin array $\mathbf{70}_f$ on a front pin block $\mathbf{72}_f$ on the underside of floor 46 of handle 8. Similarly, there are twelve back connecting pins contained $\mathbf{52}_b$ in a back pin array $\mathbf{70}_b$ on a back pin block $\mathbf{72}_b$ on the underside of floor 46 of handle 8. See FIG. 5 which illustrates both the front and back pin arrays $\mathbf{70}_f$ and $\mathbf{70}_b$ contained on the underside of floor 46 of handle 8.

Each connecting pin 52 has an arrow shaped head 74 connected to an outwardly extending shaft 76. Shaft 76 of pin 52 passes through a bore in that pin block 72 in which pin 52 is slidably contained. A spring 78 is compressed between the inner side of pin block 72 and the back side of head 74 of pin 52. Spring 78 biases pin 52 inwardly relative to floor 46 of handle 8 to move head 74 of pin 52 towards the center of floor 46.

Head 74 of pin 52 abuts against one of the cam lobes 67 on cam actuator 66 of key k. Head 74 of front connecting pin $\mathbf{52}_f$ abuts against front cam lobe $\mathbf{67}_f$ on cam actuator 66 while head 74 of back connecting pin $\mathbf{52}_b$ abuts against back cam lobe $\mathbf{67}_b$ on cam actuator 66. This is depicted in FIGS. 7 and 8 which show how heads 74 of the front and back connecting pins $\mathbf{52}_f$ and $\mathbf{52}_b$ in each pair point inwardly towards one another to ride on the oppositely disposed cam lobes $\mathbf{67}_f$ and $\mathbf{67}_b$ of cam actuator 66.

When each key k is in its raised non-selecting position, cam actuator 66 is raised sufficiently so that the front and back connecting pins $\mathbf{52}_f$ and $\mathbf{52}_b$ controlled by that cam actuator 66 are able to slide towards one another. Heads 74 of pins 52 are able to contact or closely approach one another. The bias of springs 78 urges pins 52 inwardly towards one another. In the non-selecting position as shown in FIG. 7, the outer ends of shafts 76 of pins 52 are retracted into the front and back pin blocks 72.

If the user now depresses key k, as shown in FIG. 8, the front and back connecting pins $\mathbf{52}_f$ and $\mathbf{52}_b$ in this pair of pins 52 move or slide apart in opposite directions from one another. This is caused by the increasing depth of the cam profiles of the front and back cam lobes $\mathbf{67}_f$ and $\mathbf{67}_b$, namely connecting pins 52 get cammed apart by cam actuator 66 as key k is forced downwardly. Once key k is fully depressed, the front and back cam lobes have slipped below heads 74 of pins 52 and heads 74 of pins 52 are now held in detents 65 located immediately above cam lobes 67. In this position, shafts 76 of connecting pins 52 have now been extended or projected out of the front and back pin blocks 72. The outer ends of shafts 76 are now exposed and can be used to couple one weight 4 to handle 8.

Figure 9:
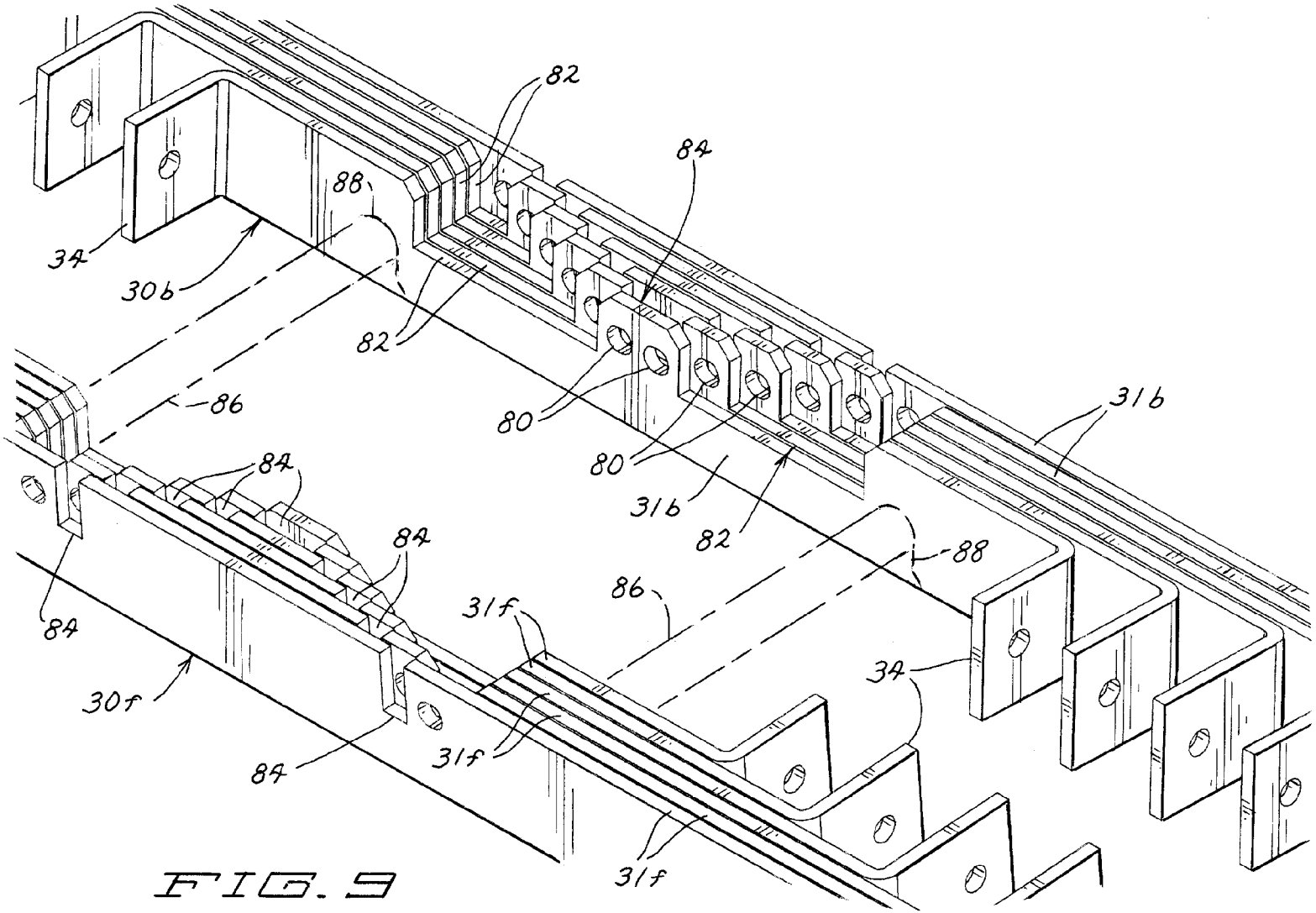
FIG. 9 is a perspective view of the connecting rails that form part of the weight frame of each weight, particularly illustrating the pin receiving apertures on the different weight frames and how the weight frames formed by the connecting rails nest inside one another.
Figure 10:
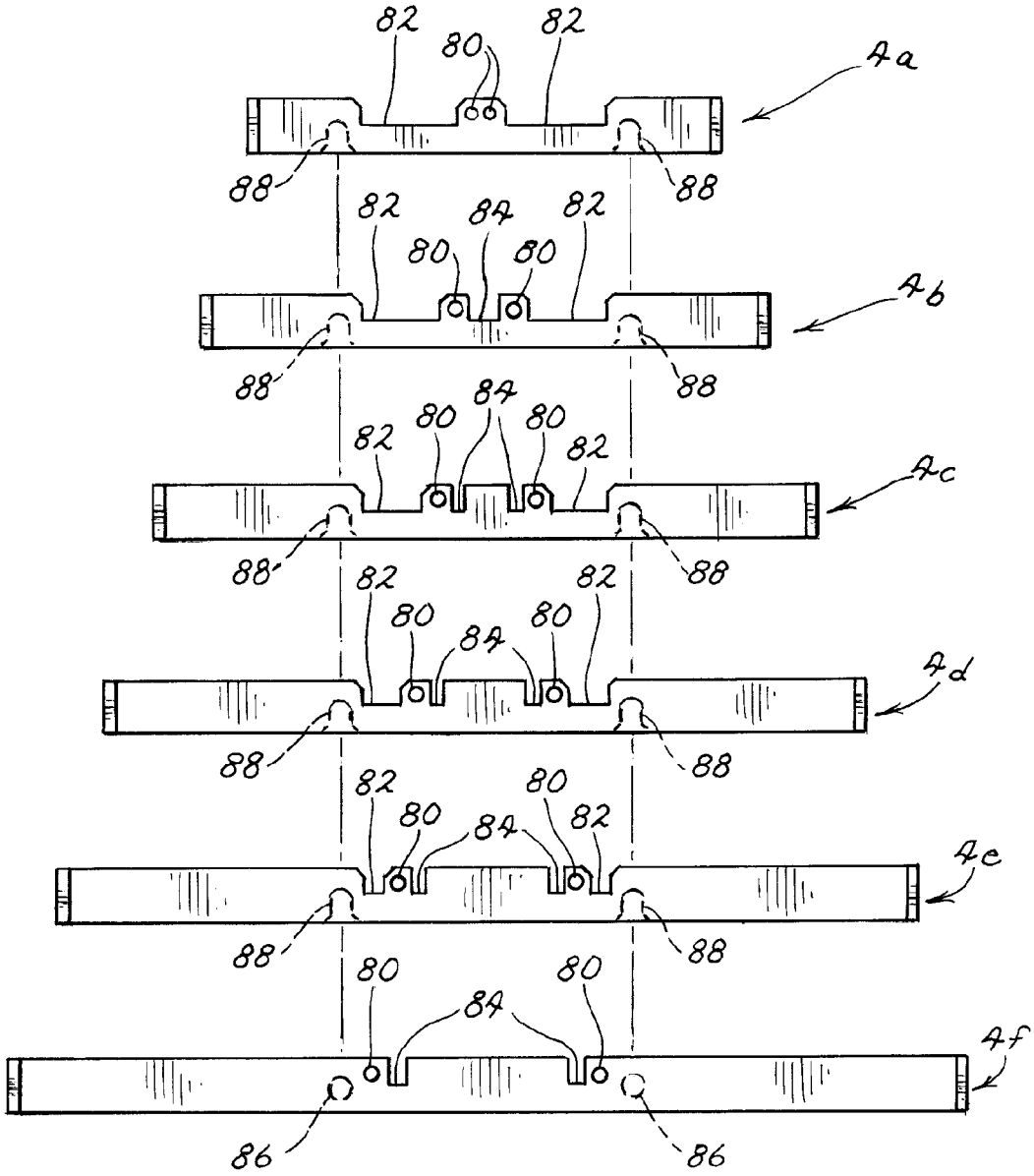
FIG. 10 is a side elevational view of the connecting rails shown in FIG. 9, but illustrating the connecting rails in an exploded condition to better illustrate the offset placement of the pin receiving apertures on the different weight frames as well as the pin clearance slots on the different weight frames.

As shown in FIGS. 9 and 10, the front and back walls 31 of each weight frame 32 of each weight 4 have apertures 80 therein for receiving the outer ends of shafts 76 of connecting pins 52 when such shafts project outwardly from the front and back pin blocks. In other words, for each pair of connecting pins 52, there is one aperture 80 in each front wall $\mathbf{31}_f$ and one aperture 80 in each back wall $\mathbf{31}_b$ of each weight frame 32. Because selector 10 desirably uses two keys k to select each weight 4, and because each key k actuates its own separate pair of connecting pins 52, there are actually two apertures 80 on each of the front and back walls $\mathbf{31}_f$ and $\mathbf{31}_b$ of each weight frame 32. Thus, when the pair of keys k used to select each weight 4 are both depressed, a total of four connecting pins 52 project through a total of four apertures 80 on each weight 4.

Apertures 80 in front and back walls 31 of the nested weight frames 32 are staggered in a chevron like manner as shown in FIGS. 9 and 10. In other words, beginning with weight frame 32 of innermost weight $\mathbf{4}_a$, the two apertures 80 in wall 31 are arranged at the center of wall 31. Apertures 80 in wall 31 of the next outer weight $\mathbf{4}_b$ are slightly spread apart from one another to lie on either side of apertures 80 in the first weight $\mathbf{4}_a$. Similarly, apertures 80 in wall 31 of the third weight $\mathbf{4}_c$ are further spread apart from one another to lie on either side of apertures 80 in the second weight $\mathbf{4}_b$, and so on all the way out to the sixth and outermost weight $\mathbf{4}_f$. Thus, looking at FIG. 9, one can see that apertures 80 are arranged along the inclined sides of a chevron shape. Apertures 80 are identical whether one is describing the front walls $\mathbf{31}_f$ or the back walls $\mathbf{31}_b$ of each weight frame 32.

Each front and back wall 31 also include a pair of slots 82 outboard of apertures 80 in front and back walls 31. These outboard slots 82 are sized and arranged to allow for the passage of the connecting pins 52 used for the other outer weights 4. For example, referring to wall 31 of weight frame 32 of innermost weight $\mathbf{4}_a$, two large outboard slots 82 are provided on either side of the two central apertures 80. These outboard slots 80 are placed in front of all of apertures 80 in the walls 31 of the other weights $\mathbf{4}_b$-$\mathbf{4}_f$ such that these apertures are exposed to receive their own respective connecting pins 52. In other words, outboard slots 82 are needed to prevent one weight 4 from blocking access to the apertures 80 in the other outer weights 4.

The size and location of outboard slots 82 used for pin clearance necessarily vary from weight to weight. Referring to FIG. 10 and looking at wall 31 of the second weight $\mathbf{4}_b$, outboard slots 82 are shorter and further out than slots 82 in the first weight $\mathbf{4}_a$. Similarly, looking at wall 31 of the third weight $\mathbf{4}_c$, outboard slots 82 are still shorter and further out than outboard slots 82 in the second weight $\mathbf{4}_b$, and so on all the way out to the outermost or sixth weight $\mathbf{4}_f$. This last weight has no slots 82 outboard of apertures 80 therein since there are no other weights that are nested outside of the last weight $\mathbf{4}_f$.

In addition to outboard slots 82, walls 31 of weights 4, except for walls 31 of the first or innermost weight $\mathbf{4}_a$, also have a slot or slots 84 inboard of apertures 80. Inboard slots 84 lie immediately behind apertures 80 in the preceding weight 4. In other words, the single inboard slot 84 in the second weight $\mathbf{4}_b$ lies immediately behind the two apertures 80 in the first weight $\mathbf{4}_a$ The pair of inboard slots 84 in the third weight $\mathbf{4}_c$ lie immediately behind the two apertures 80 in the second weight $\mathbf{4}_b$ and so on.

Inboard slots 84 allow the outer ends of shafts 76 of connecting pins 52 used to couple the preceding weight to project into inboard slots 84 to accommodate small tolerance variations in the length of shafts 76. In other words, it is not critical that each shaft be closely controlled as to length. If one shaft 76 is a bit longer than another, the longer shaft 76 will simply extend slightly into the inboard slot or slots 84 provided therefor in the following weight 4.

Figure 5:
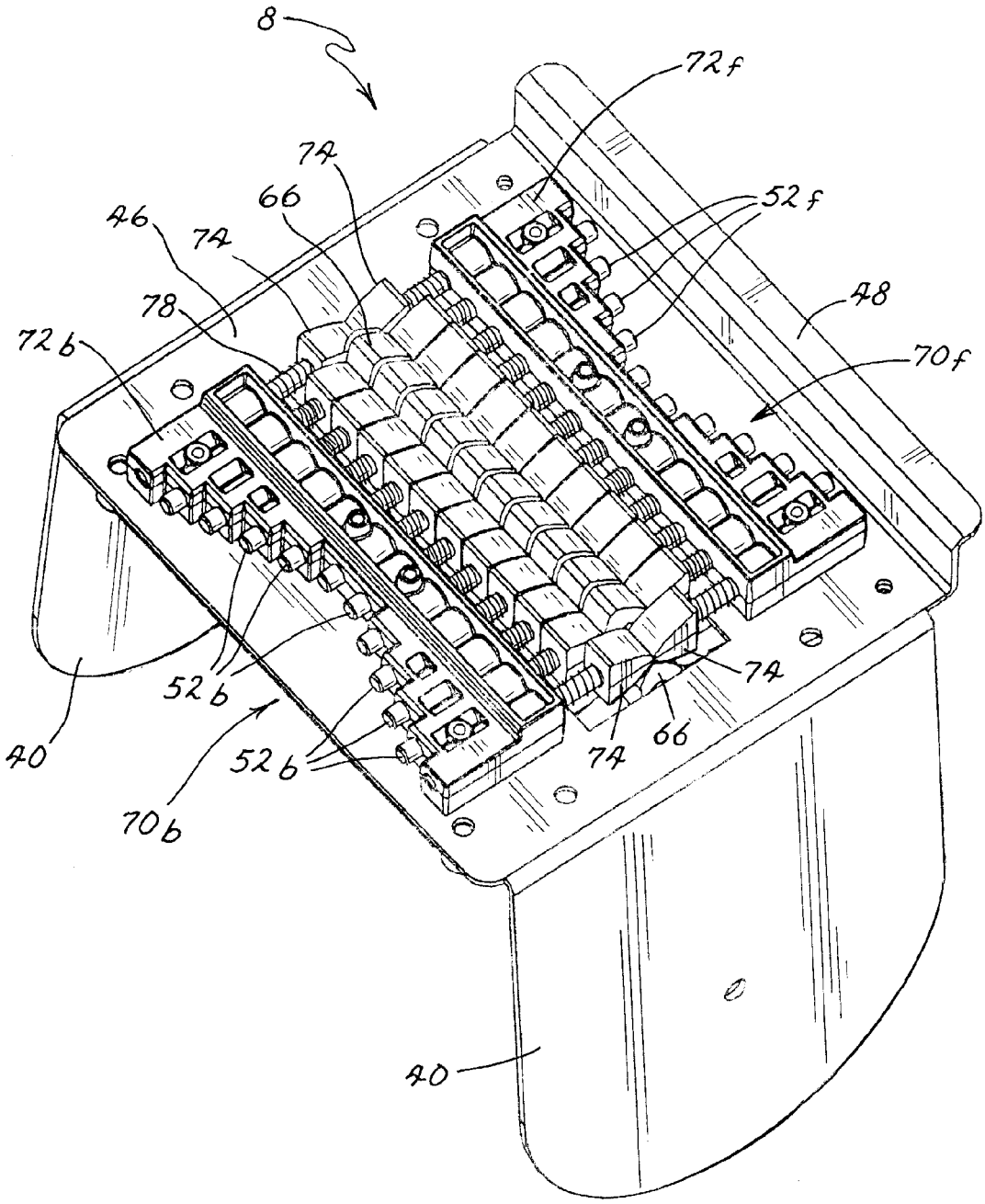
FIG. 5 is a perspective view of the bottom of the handle of the selectorized dumbbell of FIG. 1, particularly illustrating the front and back arrays of connecting pins of the selector.

As seen most clearly in FIG. 5, shafts 76 of the various connecting pins 52 also have a progressively varying length as one proceeds from connecting pins 52 used for the innermost weight $\mathbf{4}_a$ to connecting pins 52 used for the outermost weight $\mathbf{4}_f$. Thus, the outer ends of shafts 76 of connecting pins 52 in both the front and back pin arrays $\mathbf{70}_f$ and $\mathbf{70}_b$ also have a chevron shape similar to the chevron shape of apertures 80 in walls 31 of weight frames 32. This is desirable since the travel or distance that each pin 52 must be thrown in order to couple to its respective weight 4 is approximately the same. Thus, heads 74 of pins 52, and the profiles of the cam lobes 67 on cam actuators 66, can be identical irrespective of which pins 52 in the arrays 70 are being actuated.

In addition, because of the increasing length of shafts 76 of pins 52, the shafts 76 of the pins for the outer weights 4 necessarily overlie the side walls 31 of the inner weights 4. However, this overlying is permitted because of the outboard slots 82 in the side walls 31.

With selector 10 of this invention, connecting pins 52 in the front and back pin arrays $\mathbf{70}_f$ and $\mathbf{70}_b$ must be aligned with the various apertures 80 in front and back walls $\mathbf{31}_f$ and $\mathbf{31}_b$ of weight frames 32. If they are misaligned, a pin 52 may not properly enter its respective aperture 80. Desirably, weight frames 32 and selector 10 will simply be manufactured precisely enough to ensure such alignment.

However, if need be, various ways could be utilized to ensure alignment to permit proper pin and aperture registration. As shown in FIGS. 9 and 10, weight frame 32 of the outermost weight $\mathbf{4}_f$ can include a pair of alignment bars 86 extending between front and back walls $\mathbf{31}_f$ and $\mathbf{31}_b$ thereof. Each weight frame 32 of the inner weights $\mathbf{4}_a$ -$\mathbf{4}_e$ would include a pair of downwardly facing alignment notches 88 in front and back walls 31 for receiving alignment bars 86. Thus, when all six weights are nested together, notches 88 in the inner five weights $\mathbf{4}_a$-$\mathbf{4}_e$ will be received on alignment bars 86 of the sixth weight $\mathbf{4}_f$ to ensure that all of the apertures 80 will be properly aligned with connecting pins 52 to smoothly receive connecting pins 52. Alignment bars 86 could also be provided on a stand for holding dumbbell 2 in which case even the outermost weight $\mathbf{4}_f$ would include the alignment notches 88.

Other ways of dealing with this alignment issue could be utilized. The outer ends of shafts 76 of connecting pins 52 could be chamfered to make pins 52 self aligning in apertures 80. Alternatively, apertures 80 themselves could be elongated or oval in nature to provide extra tolerance for receiving shafts 76 of connecting pins 52.

Selector 10 of this invention is intuitive and easy to use. The user will easily and quickly understand that all that needs to be done is to depress keys k for whatever exercise mass is desired. This intuitive understanding is enhanced since the twelve keys in the key pattern, namely keys:

12 10 8 6 4 2 1 3 5 7 9 11 correspond visually and operationally to the six left weight plates $\mathbf{6}_l$ and the six right weight plates $\mathbf{6}_r$. In effect, the user is looking at the weight plates as the user looks at the keyboard. If the user wants to select the three inner left weight plates $\mathbf{6}_l$ and the three inner right weight plates $\mathbf{6}_r$ of the first three inner weights $\mathbf{4}_a$-$\mathbf{4}_c$, the user need only depress the corresponding three left inner keys $k_6$, $k_4$, $k_2$ and the three right inner keys $k_1$, $k_3$, $k_5$. These are simply the keys which occupy the same positions in keyboard 50 as do the desired nested left and right weight plates $\mathbf{6}_l$ and $\mathbf{6}_r$ within the entire assembly of weights 4.

There is also no need to have a separate connecting pin that needs to be manually inserted into different slots or locations on handle 8 or on weight frames 32. Keyboard 50 is always in place and never changes location on handle 8. Keyboard 50 simply invites the user to press down those keys k that are needed to select the desired weights 4.

In addition, weights 4 in dumbbell 2 are now individually pinned or coupled to handle 8 using discrete connecting pins 52 dedicated to the coupling of each weight 4. If three weights 4 are coupled to handle 8, a total of twelve pins 52 (four pins 52 per weight) take the load, instead of only a single or double pronged connecting pin as in prior art selectorized dumbbells. Thus, connecting pins 52 can be made lighter and smaller and can even be molded out of a rigid plastic material, thereby facilitating permanent placement on handle 8, since they individually need not carry an extremely heavy load. Pins 52 could also be molded out of a UHMW-PE material that would deform without breaking when such pins 52 see an impact load. The number of connecting pins used increases with the increasing weight of dumbbell 2.

In addition, the keyboard/connecting pin arrangement shown herein is believed to be safer and more reliable in operation. Because two keys k are used to couple each weight 4 to handle 8 using two pairs of front and back connecting pins 52, it is unlikely that both keys k would be inadvertently disengaged at the same time. Thus, even if one key k were inadvertently lifted, the other key will remain depressed with its pair of connecting pins 52 still coupling the selected weight to handle 8. The presence of the L-shaped guard 48 on the front of floor 46 of handle 8 further protects keys k from accidentally being pushed up or lifted by banging the front side of dumbbell 2 down onto the edge of a stand, workout bench or rack. The impact will be taken by guard 48 and not keys k.

The spring bias on connecting pins 52 also ensures that each key k is positively held in either the lowered selecting position or the raised non-selecting position. If a key k is only partially depressed and then released, the spring bias on connecting pins 52 will act on the cam lobes to cause key k to return all the way back up to its raised non-selecting position. Key k must be firmly depressed all the way to its lowered selecting position in order to be retained therein with heads 74 of connecting pins 52 then held in the detents 65 located above the cam lobes 67. Thus, keys k are held in bi-stable positions comprising either the raised or lowered positions and cannot be inadvertently disposed or hung up in between such positions.

Pin arrays 70 are mirror images relative to one another. In addition, the pins 52 in each array 70 are disposed in mirror images along each side of the chevron. Moreover, apertures 80 are disposed in mirror image sets in the front and rear side walls. Thus, if a user picks up handle 8 with some weights 4 attached, and then inadvertently replaces handle 8 in a reversed position that is 180° offset from the position in which handle 8 was picked up, it will not matter to the proper functioning of dumbbell 2. All the apertures 80 and connecting pins 52 will still be properly aligned regardless of whether handle 8 is reversed when it is set back down between the stacks of nested left and right weight plates 6.

The ability of selector 10 to work properly whether handle 8 is reversed or not when it is set down between the stacks of nested left and right weight plates 6 is desirable. In a showroom setting, users who are unfamiliar with the equipment will often replace handle 8 in a 180° reversed position. If the selector 10 were designed so that it would not properly work if this were to occur, i.e. if handle 8 always had to be replaced in the same orientation as when it was picked up, this would give the erroneous impression that the dumbbell was broken. Having a dumbbell whose selector 10 will function exactly the same in either possible position of handle 8 avoids giving this impression and is also much easier to use since the user need not pay attention to the precise position of handle 8.

It would be possible for only a single key k and pair of connecting pins 52 arranged on the centerline of the innermost weight $\mathbf{4}_a$ to be used in place of the pair of keys $k_1$ and $k_2$ and the dual pairs of connecting pins 52. Such a single key k would lie exactly along the apex of the chevron shape of the front and back pin arrays 70. Such a construction would still provide a reversible handle 8 as described above. However, it is preferred that the innermost weight $\mathbf{4}_a$ use a pair of keys so that its operation is like that of all the other weights.

Various modifications of this invention will be apparent to those skilled in the art. For example, weight frames 32 could be split in half such that each left weight plate $\mathbf{6}_l$ is no longer coupled to each right weight plate $\mathbf{6}_r$. Each left weight plate $\mathbf{6}_l$ would be individually coupled to handle 8 using one of the even numbered keys k and each right weight plate $\mathbf{6}_r$ would be similarly individually coupled using the odd numbered keys k. Such an arrangement would allow different numbers of weight plates to be simultaneously coupled to the left and right ends of handle 8.

In addition, while apertures 80 have been shown as being contained within the height of side walls 31, apertures 80 could be provided in tabs that project upwardly from the top edges of side walls 31. In this case, the outboard and inboard slots 82 and 84, respectively, would not need to be present as the open spaces above the side walls on either side of the tabs would serve the same purposes as slots 82 and 84.

Thus, the scope of this invention is to be limited only by the appended claims.

We claim:

1. A selectorized dumbbell, which comprises:

(a) a plurality of nested weights which provide a set of nested left weight plates and a set of nested right weight plates separated by a gap;

(b) a handle having a hand grip, wherein the handle is insertable into the gap between the sets of nested left and right weight plates with the hand grip extending along an axis that is substantially perpendicular to that of the weight plates; and (c) a selector for coupling selected numbers of weights to the handle, wherein the selector includes a keyboard that is operable by a user to select the weights that are to be coupled to the handle, and wherein the keyboard is carried on the handle beneath the hand grip.

2. The dumbbell of claim 1, wherein the keyboard has a plurality of keys which can each be selectively moved by the user between a weight selecting position and a weight non-selecting position, wherein the number of weights coupled to the handle is related to the number of keys moved into the weight selecting positions thereof.

3. The dumbbell of claim 2, wherein the keys are biased into the selecting and non-selecting positions thereof such that the keys will not remain in positions between the selecting and non-selecting positions.

4. The dumbbell of claim 3, wherein the keys are bi-stably retained in both the selecting position and the non-selecting position.

5. A selectorized dumbbell, which comprises:

(a) a plurality of nested weights;

(b) a handle; and (c) a selector for coupling selected numbers of weights to the handle, wherein the selector includes a keyboard that is operable by a user to select the weights that are to be coupled to the handle, wherein the keyboard has a plurality of keys which can each be selectively moved by the user between a weight selecting position and a weight non-selecting position, wherein the number of weights coupled to the handle is related to the number of keys moved into the weight selecting positions thereof, and wherein a pair of keys controls the selection of each weight such that the pair of keys for a particular weight must both be moved into their selecting positions for that particular weight to be coupled to the handle.

6. A selectorized dumbbell, which comprises:

(a) a plurality of nested weights;

(b) a handle; and (c) a selector for coupling selected numbers of weights to the handle, wherein the selector includes a keyboard that is operable by a user to select the weights that are to be coupled to the handle, wherein the nested weights are disposed in a set of weights beginning with an innermost weight and a plurality of outer weights that lead to an outermost weight, wherein the keyboard includes a plurality of keys that are disposed in a set of keys having a similar arrangement of an innermost key and a plurality of outer keys that lead to an outermost key, and wherein the keys in the set of keys are interlocked to one another such that depressing one key in the set requires that any of the keys inside of the depressed key also be depressed.

7. A selectorized dumbbell, which comprises:

(a) an array of nested weights comprising a stack of nested left weight plates and a stack of nested right weight plates;

(b) a handle having a left end and a right end; and (c) a selector for coupling selected numbers of left weight plates to the left end of the handle and selected numbers of right weight plates to the right end of the handle, wherein the selector includes a plurality of keys equal to the number of the weight plates with the keys being placed on a keyboard in an arrangement in which all the keys are directly adjacent one another in a single, substantially continuous, unbroken row of keys and with the arrangement of keys corresponding to that of the array of nested left and right weight plates, wherein the keys are selectively actuable by a user such that actuation of a key in the keyboard selects for coupling to the handle that weight plate whose position in the array of weight plates is the same as the position of the actuated key in the keyboard.

8. A selectorized dumbbell, which comprises:

(a) a plurality of nested weights;

(b) a handle;

(c) a selector for coupling selected numbers of weights to the handle, wherein the selector includes a plurality of connecting pins, and wherein at least a first pair of connecting pins is used to couple each separate and discrete weight to the handle; and further including a cam actuator for each pair of connecting pins, wherein the cam actuator has a selecting position in which the cam actuator has cammed the pair of connecting pins apart to engage the pair of connecting pins to the weight to couple the weight to the handle.

9. The dumbbell of claim 8, wherein the connecting pins are carried on the handle even when the connecting pins are not in use.

10. The dumbbell of claim 8, wherein the connecting pins are spring biased towards one another to bias the cam actuator into a non-selecting position.

11. The dumbbell of claim 10, wherein the cam actuator is bi-stably retained in either the selecting or non-selecting positions.

12. The dumbbell of claim 11, wherein each cam actuator is carried on an underside of a separate depressible key such that a particular cam actuator moves between the non-selecting and selecting positions by depressing the key that carries the particular cam actuator.

13. The dumbbell of claim 8, wherein a second pair of separate and discrete connecting pins is further used to couple each weight to the handle.

14. The dumbbell of claim 13, wherein the first and second pairs of connecting pins engage each weight at locations that are disposed on either side of a centerline of the weight.

15. The dumbbell of claim 8,wherein the selector also includes a plurality of keys on a keyboard with at least one key being provided for moving each connecting pin in the at least first pair of connecting pins that couples each weight to the handle.

16. A selectorized dumbbell, which comprises:

(a) a plurality of nested weights;

(b) a handle;

(c) a separate pair of connecting pins for connecting each of the weights to the handle; and (d) wherein the connecting pins in each pair are aligned on a common axis with the pins extending outwardly along the axis away from one another to couple a weight to the handle and the pins extending inwardly along the axis towards one another to uncouple the weight from the handle.

17. The dumbbell of claim 16, wherein the pins in each pair of pins are spring biased towards one another.

18. The dumbbell of claim 17, wherein the pins in each pair of pins have heads that are adjacent one another at a junction therebetween under the influence of the spring biasing.

19. The dumbbell of claim 18, further including an actuator acting against the heads at the junction therebetween to force the heads of the pins apart when the actuator is forced vertically through the junction between the heads.

20. The dumbbell of claim 19, wherein the heads of the pins are arrow shaped.

21. A selectorized dumbbell, which comprises:

(a) a plurality of nested weights;

(b) a handle; and (c) a selector for coupling selected numbers of weights to the handle, wherein the selector includes a pin array having a plurality of connecting pins whose length increases from one pin to the next, and wherein the connecting pins in the pin array are continuously carried on the handle regardless of whether the connecting pins are in a weight uncoupling position on the handle in which the pins are spaced from the weights or whether the connecting pins have been moved on the handle into a weight coupling position in which the pins are engaged with the weights.

22. The dumbbell of claim 21, wherein two identical pin arrays are present in the selector with the pin arrays acting in opposite directions.

23. The dumbbell of claim 22, wherein the weights have a pair of sets of nested side walls, and wherein one pin array coacts with one set of nested side walls and the other pin array coacts with the other set of nested side walls when coupling the weights to the handle.

24. The dumbbell of claim 21, wherein the handle has a hand grip, and wherein the pin array is carried on the handle beneath the hand grip.

25. The dumbbell of claim 24, wherein the pins in the pin array move on the handle in a direction perpendicular to the hand grip.

26. A selectorized dumbbell, which comprises:

(a) a plurality of nested weights which provide a set of nested left weight plates and a set of nested right weight plates separated by a gap, wherein the weights include apertures therein;

(b) a handle having a hand grip, wherein the hand is insertable into the gap between the sets of the nested left and right weight plates with the handle extending along an axis that is substantially perpendicular to that of the weight plates; and (c) a selector for coupling selected numbers of weights to the handle, wherein the selector includes a plurality of individually movable connecting pins continuously carried on the handle regardless of whether the connecting pins are in a weight uncoupling position on the handle in which the pins are spaced from the weights or whether the connecting pins have been moved on the handle into a weight coupling position in which the pins are engaged with the weights, with the connecting pins being received in the apertures for connecting the weights to the handle, and wherein the apertures and connecting pins are configured to permit the handle to be inserted into the gap in a first position or in a second position that is 180° reversed from the first position without affecting the ability of the apertures and the connecting pins to couple the weights to the handle.

* * * * *

UNITED STATES PATENT AND TRADEMARK OFFICE

CERTIFICATE OF CORRECTION

PATENT NO. : 7,520,845 B2
APPLICATION NO. : 11/498335
DATED : April 21, 2009
INVENTOR(S) : Carl K. Towley, III et al.

It is certified that error appears in the above-identified patent and that said Letters Patent is hereby corrected as shown below:

Col. 16, Line 15, change "hand" to --handle--.

Signed and Sealed this

Twenty-fifth Day of August, 2009

David J. Kappos

David J. Kappos
*Director of the United States Patent and Trademark Office*